US009183978B2

(12) United States Patent
Ahn et al.

(10) Patent No.: US 9,183,978 B2
(45) Date of Patent: Nov. 10, 2015

(54) FILTER FOR REMOVING NOISE

(71) Applicant: Samsung Electro-Mechanics Co., Ltd., Suwon (KR)

(72) Inventors: Young Ghyu Ahn, Suwon (KR); Sung Kwon Wi, Suwon (KR); Dong Seok Park, Suwon (KR); Yong Suk Kim, Suwon (KR); Ill Kyoo Park, Suwon (KR); Young Seuck Yoo, Suwon (KR); Sang Soo Park, Suwon (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 81 days.

(21) Appl. No.: 13/961,473

(22) Filed: Aug. 7, 2013

(65) Prior Publication Data

US 2014/0104027 A1 Apr. 17, 2014

(30) Foreign Application Priority Data

Aug. 8, 2012 (KR) ..... 10-2012-0086756

(51) Int. Cl.
*H01F 5/00* (2006.01)
*H01F 27/28* (2006.01)
*H01F 27/00* (2006.01)

(52) U.S. Cl.
CPC ..... *H01F 27/2804* (2013.01); *H01F 27/006* (2013.01); *H01F 2027/2809* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 5,572,179 | A * | 11/1996 | Ito et al. | 336/200 |
| 5,801,521 | A * | 9/1998 | Mizoguchi et al. | 323/282 |
| 2003/0151482 | A1* | 8/2003 | Mayfield | 336/180 |
| 2004/0130415 | A1* | 7/2004 | Chiba et al. | 333/185 |
| 2007/0001794 | A1* | 1/2007 | Alford et al. | 336/200 |
| 2010/0026368 | A1* | 2/2010 | Tang et al. | 327/361 |
| 2010/0157565 | A1* | 6/2010 | Yoshida et al. | 361/811 |
| 2011/0043316 | A1* | 2/2011 | Yang et al. | 336/192 |

FOREIGN PATENT DOCUMENTS

| | | | |
|---|---|---|---|
| JP | 6-61072 | | 3/1994 |
| JP | 8-203737 | | 8/1996 |
| JP | 2006086460 | A * | 3/2006 |
| JP | 2010-516056 | | 5/2010 |

* cited by examiner

*Primary Examiner* — Tsz Chan
(74) *Attorney, Agent, or Firm* — McDermott Will & Emery LLP

(57) ABSTRACT

The present invention discloses a filter for removing noise, which includes: a lower magnetic body; primary and secondary patterns spirally provided on the lower magnetic body in parallel to each other; an insulating layer for covering the primary and secondary patterns; and an upper magnetic body provided on the insulating layer, wherein the primary and secondary patterns are formed to have a ratio of vertical thickness (T) to horizontal width (W) of $0.27 \leq T/W \leq 2.4$. According to the present invention, it is possible to improve performance and capacity by implementing high common-mode impedance in the same frequency and reduce manufacturing costs by simplifying structures and processes.

16 Claims, 8 Drawing Sheets

- PRIOR ART -

- PRIOR ART -

FILTER FOR REMOVING NOISE

CROSS-REFERENCE TO RELATED APPLICATIONS

Claim and incorporate by reference domestic priority application and foreign priority application as follows:

CROSS REFERENCE TO RELATED APPLICATION

This application claims the foreign priority benefit under 35 U.S.C. Section 119 of Korean Patent Application Serial No. 10-2012-0086756, filed Aug. 8, 2012, which is hereby incorporated by reference in its entirety into this application.

BACKGROUND OF THE INVENTION

1. Field of the Invention

The present invention relates to a filter for removing noise, and more particularly, to a filter for removing noise that can improve performance and capacity by implementing high common-mode impedance in the same frequency and improving insertion loss and reduce manufacturing costs and improve productivity by simplifying structures and processes.

2. Description of the Related Art

Electronic products, such as digital TVs, smart phones, and notebook computers, have functions for data communication in radio-frequency bands. Such IT electronic products are expected to be more widely used since they have multifunctional and complex features by connecting not only one device but also USBs and other communication ports.

Here, for higher-speed data communication, data are communicated through more internal signal lines by moving from MHz frequency bands to GHz radio-frequency bands.

When more data are communicated between a main device and a peripheral device over a GHz radio-frequency band, it is difficult to provide smooth data processing due to signal delay and other noises.

In order to solve the above problem, an EMI prevention part is provided around the connection between an IT device and a peripheral device. However, conventional EMI prevention parts are used only in limited regions such as specific portions and large-area substrates since they are coil-type and stack-type and have large chip part sizes and poor electrical characteristics. Therefore, there is a need for EMI prevention parts that are suitable for slim, miniaturized, complex, and multifunctional features of electronic products.

A common-mode filter of EMI prevention coil parts, that is, filters for removing noise in accordance with the prior art is described below in detail with reference to FIGS. 1 to 3.

As shown in FIG. 1, a conventional common-mode filter includes a first magnetic substrate 1, an insulating layer 2 provided on the first magnetic substrate 1 and including a first coil pattern 2*a* and a second coil pattern 2*b* which are vertically symmetrical to each other, and a second magnetic substrate 3 provided on the insulating layer 2.

Here, the insulating layer 2 including the first coil pattern 2*a* and the second coil pattern 2*b* is formed on the first magnetic substrate 1 through a thin-film process. An example of the thin-film process is disclosed in Japanese Patent Application Laid-open No. 8-203737.

And, the second magnetic substrate 3 is bonded to the insulating layer 2 by an adhesive layer 4.

Further, an external electrode 5 is provided to surround both ends of a laminate including the first magnetic substrate 1, the insulating layer 2, and the second magnetic substrate 3, and the external electrode 5 is electrically connected to the first coil pattern 2*a* and the second coil pattern 2*b* through the drawn lead wire (not shown).

In the conventional common-mode filter configured as above, the first coil pattern 2*a* and the second coil pattern 2*b* are configured to vertically face each other to remove common-mode noise and smoothly pass a differential-mode signal.

More specifically, as shown in FIG. 2, the common-mode noise can't pass through the filter since magnetic fluxes generated by the current flow of the first coil pattern 2*a* and the second coil pattern 2*b* reinforce each other to have high impedance, and the differential-mode signal can smoothly pass through the filter since the magnetic fluxes offset each other.

However, in the conventional common-mode filter, as the frequency increases, the differential-mode impedance also increases, thus causing insertion loss.

That is, as the magnetic fluxes flowing between the first coil pattern 2*a* and the second coil pattern 2*b* reinforce each other and the frequency increases, the differential-mode impedance also increases, thus increasing the insertion loss.

Especially, the larger the interval between the first coil pattern 2*a* and the second coil pattern 2*b*, the higher the differential-mode impedance and the insertion loss. Accordingly, characteristics of the common-mode filter are further deteriorated.

Further, in the conventional common-mode filter, the second magnetic substrate 3 is bonded to the insulating layer 2 by the adhesive layer 4, a magnetic flux flow is further disrupted by non-magnetic characteristics of the adhesive layer 4, thus causing rapid deterioration of characteristics.

In order to overcome the above problem, although it is possible to increase the length of the first coil pattern 2*a* and the second coil pattern 2*b*, in such a case, there are disadvantages such as an increase in manufacturing costs of the filter for removing noise and an increase in size of the filter for removing noise.

SUMMARY OF THE INVENTION

The present invention has been invented in order to overcome the above-described problems and it is, therefore, an object of the present invention to provide a filter for removing noise that can improve characteristics and performance by implementing high common-mode impedance in the same frequency, reducing differential-mode impedance, and improving insertion loss.

It is another object of the present invention to provide a filter for removing noise that can minimize an increase in size of products accompanied when increasing performance and capacity.

It is still another object of the present invention to provide a filter for removing noise that can reduce manufacturing costs and improve productivity by simplifying structures and processes.

In accordance with one aspect of the present invention to achieve the object, there is provided a filter for removing noise including: a lower magnetic body; primary and secondary patterns spirally provided on the lower magnetic body in parallel to each other; an insulating layer for covering the primary and secondary patterns; and an upper magnetic body provided on the insulating layer, wherein the primary and secondary patterns are formed to have a ratio of vertical thickness (T) to horizontal width (W) of $0.27 \leq T/W \leq 2.4$.

Here, a horizontal interval (S) between the primary and secondary patterns may be in the range of 3.5 μm≤S≤12.5 μm.

The filter for removing noise may further include a resistance tuning portion which expands from a portion of the outermost pattern of the longer pattern of the primary and secondary patterns.

The upper magnetic body may extend to the center of the primary and secondary patterns.

In accordance with another aspect of the present invention to achieve the object, there is provided a filter for removing noise including: a lower magnetic body; primary and secondary patterns spirally provided on the lower magnetic body in parallel to each other; an insulating layer for covering the primary and secondary patterns; and an upper magnetic body provided on the insulating layer, wherein a horizontal interval (S) between the primary and secondary patterns is in the range of 3.5 μm≤S≤12.5 μm.

In accordance with still another aspect of the present invention to achieve the object, there is provided a filter for removing noise including: a lower magnetic body; primary and secondary lower patterns spirally provided on the lower magnetic body in parallel to each other; primary and secondary upper patterns spirally provided on the primary and secondary lower patterns in parallel to each other to correspond to the primary and secondary lower patterns while being electrically connected to the primary and secondary lower patterns, respectively; an insulating layer for covering the primary and secondary lower patterns and the primary and secondary upper patterns; and an upper magnetic body provided on the insulating layer, wherein the primary and secondary lower patterns and the primary and secondary upper patterns are formed to have a ratio of vertical thickness (T) to horizontal width (W) of 0.27≤T/W≤2.4.

Here, a horizontal interval (S) between the primary and secondary lower patterns and a horizontal interval (S) between the primary and secondary upper patterns may be in the range of 3.5 μm≤S≤12.5 μm.

The primary and secondary upper patterns may be arranged to cross the primary and secondary lower patterns.

And, the width of the primary and secondary lower patterns may be larger than the width of the primary and the secondary upper patterns.

Further, the width of the innermost pattern and the outermost pattern of the primary and secondary lower patterns may be larger than the width of the pattern positioned between the innermost pattern and the outermost pattern.

In addition, the primary and secondary upper patterns may be formed in a spiral shape continuing from the primary and secondary lower patterns and having the same number of turns.

Here, the primary and secondary upper patterns may have different numbers of turns and the primary and secondary lower patterns also may have different numbers of turns, but at this time, it is preferred that the total number of turns of the primary upper pattern and the primary lower pattern is equal to the total number of turns of the secondary upper pattern and the secondary lower pattern.

And, the primary and secondary upper patterns and the primary and secondary lower patterns may be electrically connected through vias.

Meanwhile, the filer for removing noise may further include a resistance tuning portion which expands from a portion of the outermost pattern of the longer pattern of the primary and secondary lower patterns.

And, the insulating layer may include a primary coating layer for covering the primary and secondary lower patterns and a secondary coating layer for planarizing an upper surface of the primary coating layer.

Further, the upper magnetic body may extend to the center of the primary and secondary upper patterns and the primary and secondary lower patterns.

In accordance with still another aspect of the present invention to achieve the object, there is provided a filter for removing noise including: a lower magnetic body; primary and secondary lower patterns spirally provided on the lower magnetic body in parallel to each other; primary and secondary upper patterns spirally provided on the primary and secondary lower patterns in parallel to each other to correspond to the primary and secondary lower patterns while being electrically connected to the primary and secondary lower patterns, respectively; an insulating layer for covering the primary and secondary lower patterns and the primary and secondary upper patterns; and an upper magnetic body provided on the insulating layer, wherein a horizontal interval (S) between the primary and secondary lower patterns and a horizontal interval (S) between the primary and secondary upper patterns may be in the range of 3.5≤S≤12.5.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIGS. 9*a* to 9*c* are configuration diagrams showing modified arrangement structures of the primary and secondary lower patterns and the primary and secondary upper patterns of FIG. 7, wherein FIG. 9*a* is a view showing that vertical arrangements of the primary and secondary lower patterns and the primary and secondary upper patterns are equal to each other, FIG. 9*b* is a view showing that the vertical arrangements of the primary and secondary lower patterns and the primary and secondary upper patterns are opposite to each other, and FIG. 9*c* is a view showing that the vertical arrangements of the primary and secondary lower patterns and the primary and secondary upper patterns are asymmetrical to each other;

FIGS. 10*a* and 10*b* are process diagrams schematically showing a process of forming an insulating layer on the primary and secondary lower patterns, wherein FIG. 10*a* is a view showing the state in which a primary coating layer is formed on the primary and secondary lower patterns, and FIG. 10*b* is a view showing the state in which a secondary coating layer is formed on the primary coating layer of FIG. 10*a;*

DETAILED DESCRIPTION OF THE PREFERABLE EMBODIMENTS

Figure 1:
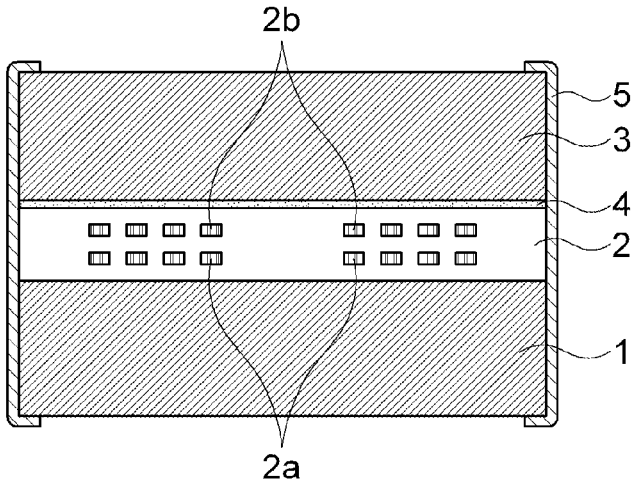
FIG. 1 is a cross-sectional view schematically showing a common-mode filter of the conventional filters for removing noise in accordance with the prior art.
Figure 2:
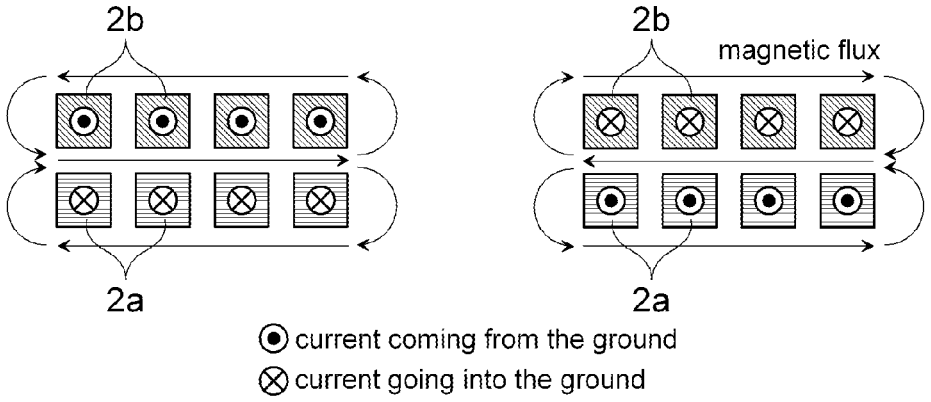
FIG. 2 is a configuration diagram schematically showing magnetic fluxes due to a primary coil pattern and a secondary coil pattern of FIG. 1.

Preferred embodiments of the present invention to achieve the above-described objects will be described with reference to the accompanying drawings. In describing the present embodiment, the same elements are represented by the same reference numerals, and additional description will be omitted below.

Hereinafter, an embodiment of a filter for removing noise in accordance with the present invention will be described in detail with reference to FIGS. 3 to 12.

Figure 3:
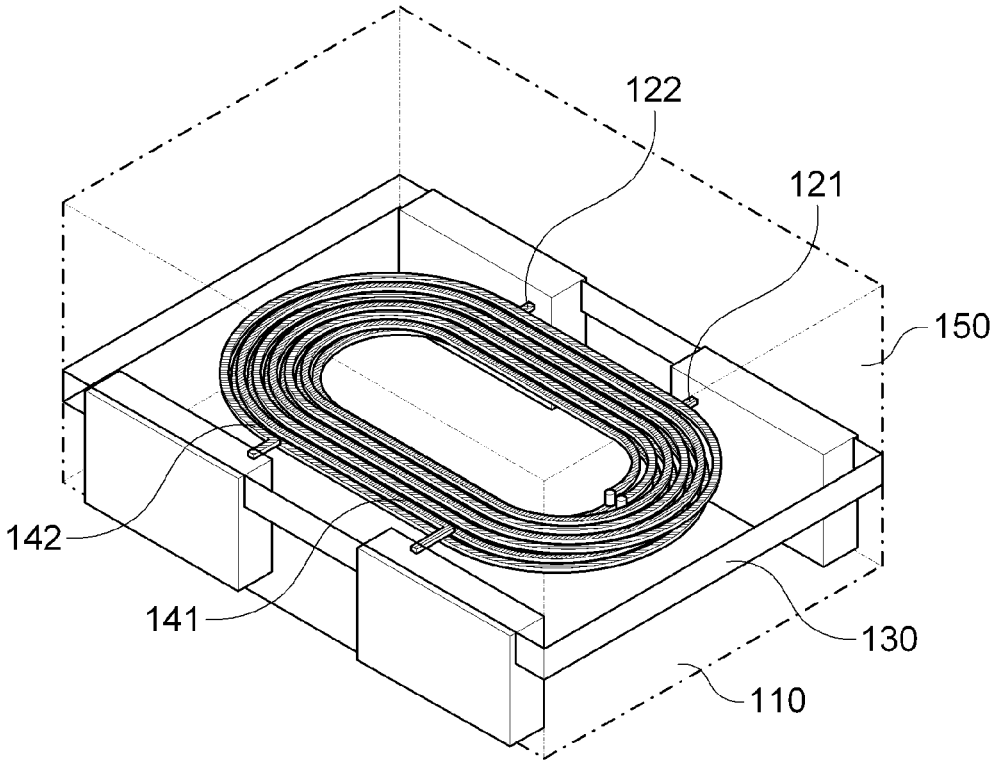
FIG. 3 is a perspective view schematically showing an embodiment of a filter for removing noise in accordance with the present invention.
Figure 4:
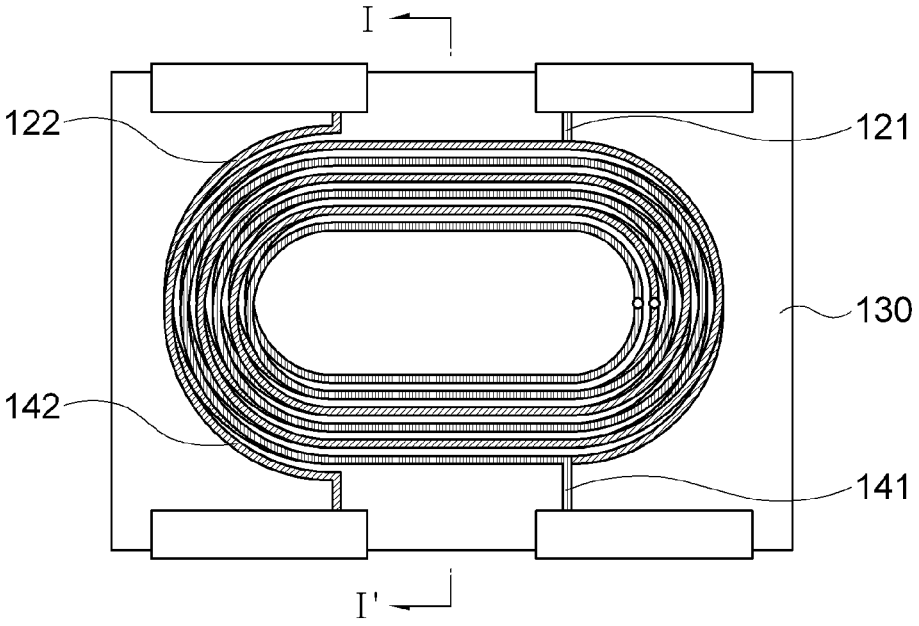
FIG. 4 is a transverse cross-sectional view of FIG. 3.
Figure 5:
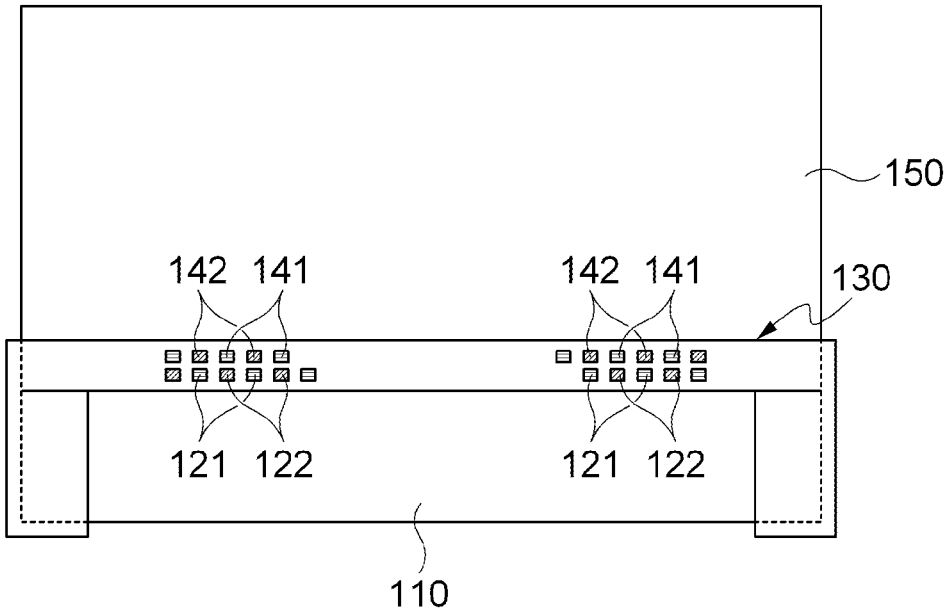
FIG. 5 is a cross-sectional view taken along line I-I' of FIG. 4.
Figure 6A:
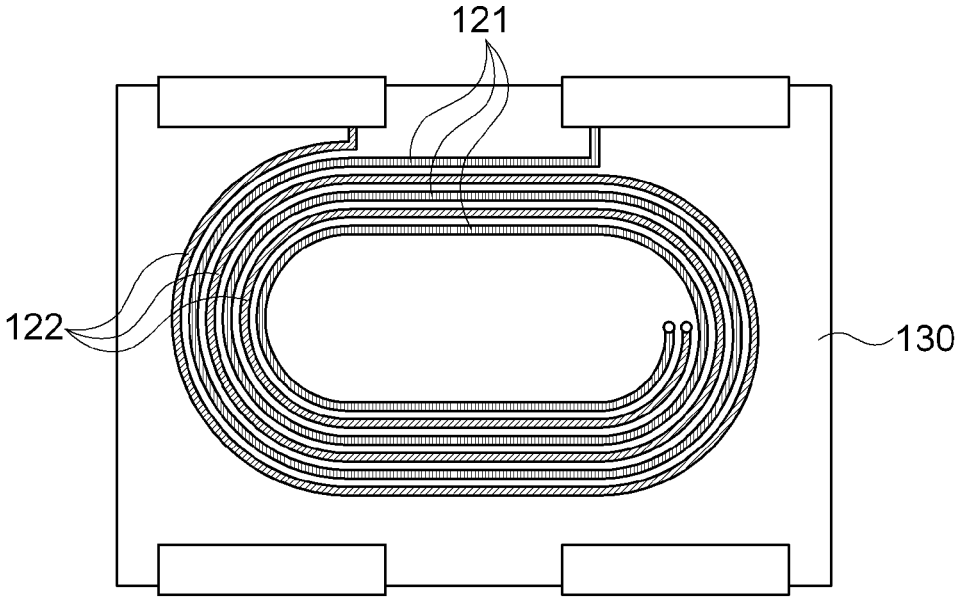
FIG. 6*a* is a plan view schematically showing primary and secondary lower patterns of FIG. 3.
Figure 6B:
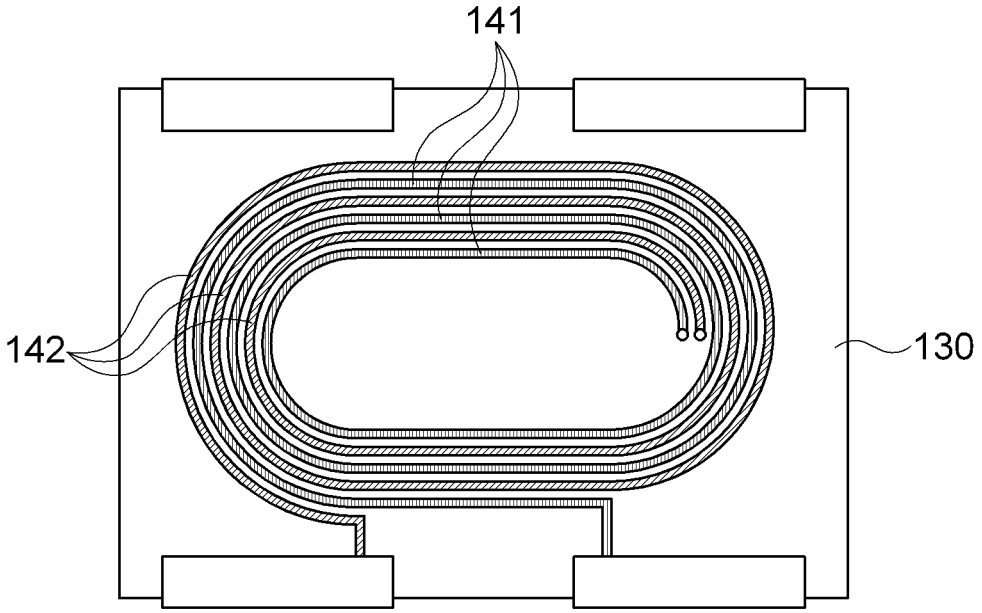
FIG. 6*b* is a plan view schematically showing primary and secondary upper patterns of FIG. 3.
Figure 7:
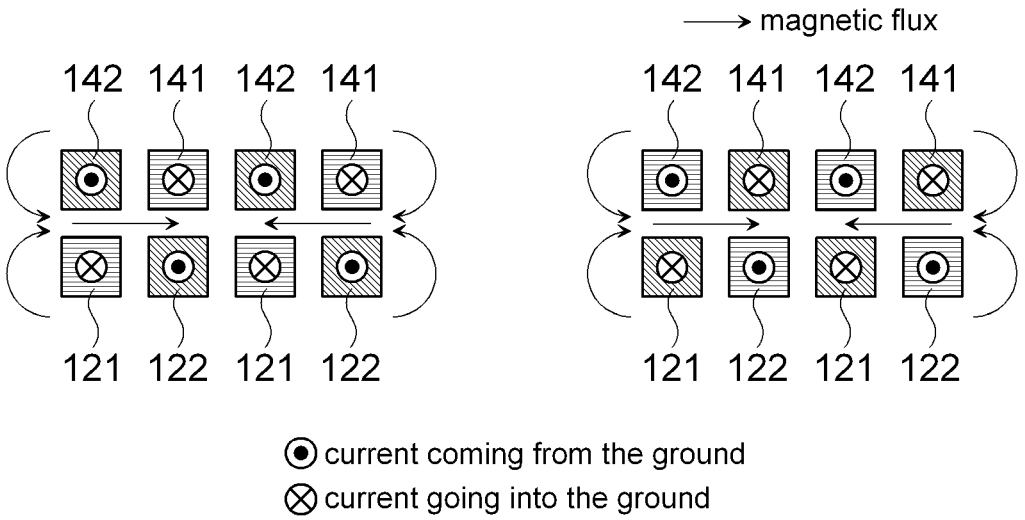
FIG. 7 is a configuration diagram schematically showing magnetic fluxes due to the primary and secondary lower patterns and the primary and secondary upper patterns applied to the filter for removing noise in accordance with the present invention.
Figure 8A:
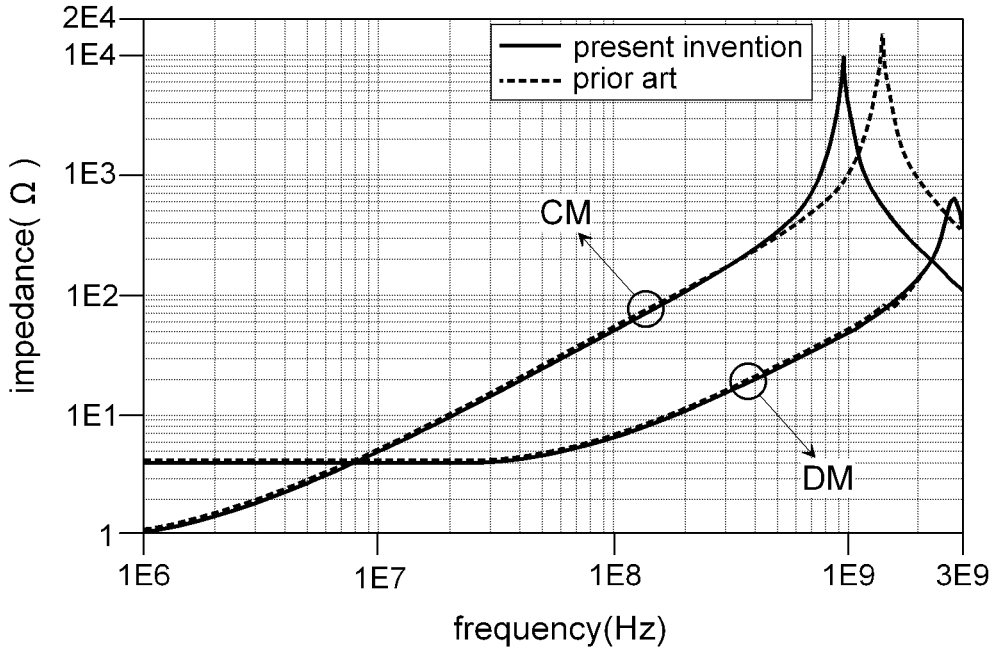
FIG. 8*a* is a graph showing the result of comparison of impedance characteristics of an embodiment of the filter for removing noise in accordance with the present invention and the conventional common-mode filter.
Figure 8B:
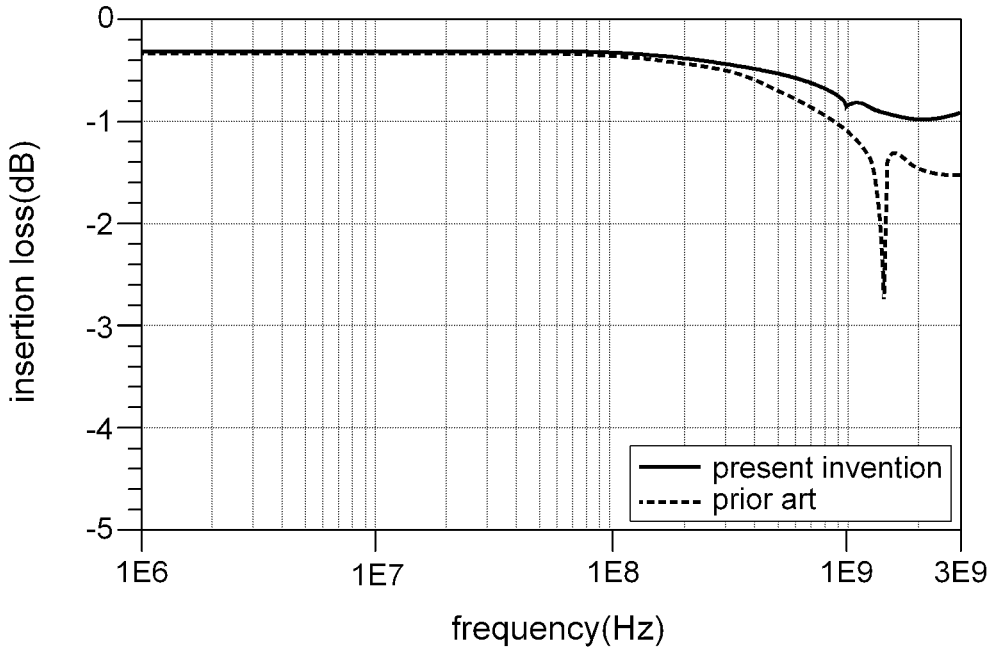
FIG. 8*b* is a graph showing the result of comparison of insertion loss characteristics of an embodiment of the filter for removing noise in accordance with the present invention and the conventional common-mode filter.

FIG. 3 is a perspective view schematically showing an embodiment of a filter for removing noise in accordance with the present invention, FIG. 4 is a transverse cross-sectional view of FIG. 3, FIG. 5 is a cross-sectional view taken along line I-I' of FIG. 4, FIG. 6*a* is a plan view schematically showing primary and secondary lower patterns of FIG. 3, FIG. 6*b* is a plan view schematically showing primary and secondary upper patterns of FIG. 3, FIG. 7 is a configuration diagram schematically showing magnetic fluxes due to the primary and secondary lower patterns and the primary and secondary upper patterns applied to the filter for removing noise in accordance with the present invention, FIG. 8*a* is a graph showing the result of comparison of impedance characteristics of an embodiment of the filter for removing noise in accordance with the present invention and a conventional common-mode filter, and FIG. 8*b* is a graph showing the result of comparison of insertion loss characteristics of an embodiment of the filter for removing noise in accordance with the present invention and the conventional common-mode filter.

Figure 9A:
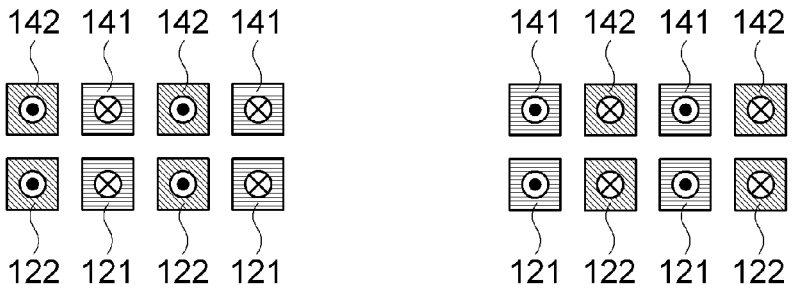
Figure 9B:
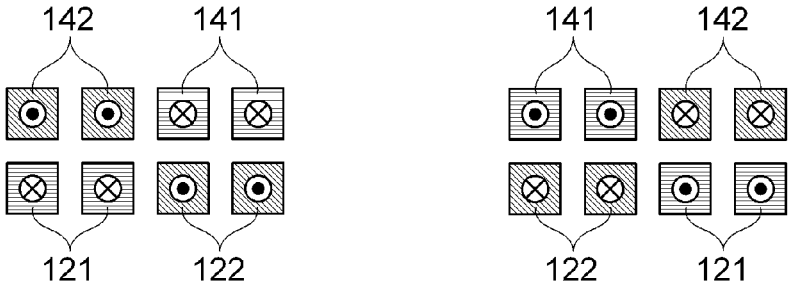
Figure 9C:
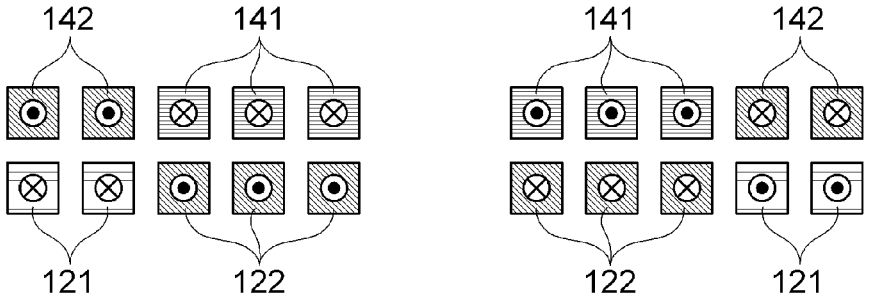

And, FIGS. 9*a* to 9*c* are configuration diagrams showing modified arrangement structures of the primary and secondary lower patterns and the primary and secondary upper patterns of FIG. 7, wherein FIG. 9*a* is a view showing that vertical arrangements of the primary and secondary lower patterns and the primary and secondary upper patterns are equal to each other, FIG. 9*b* is a view showing that the vertical arrangements of the primary and secondary lower patterns and the primary and secondary upper patterns are opposite to each other, and FIG. 9*c* is a view showing that the vertical arrangements of the primary and secondary lower patterns and the primary and secondary upper patterns are asymmetrical to each other.

Figure 10A:
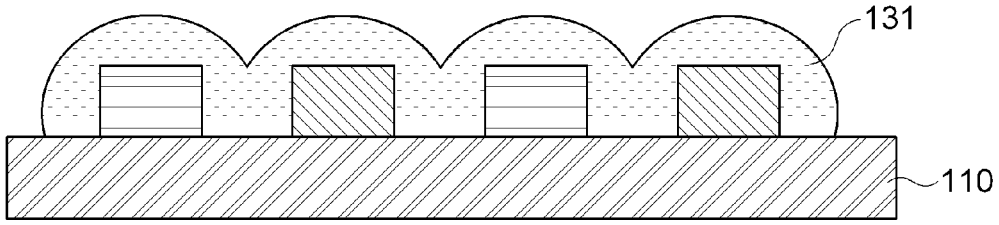
Figure 10B:
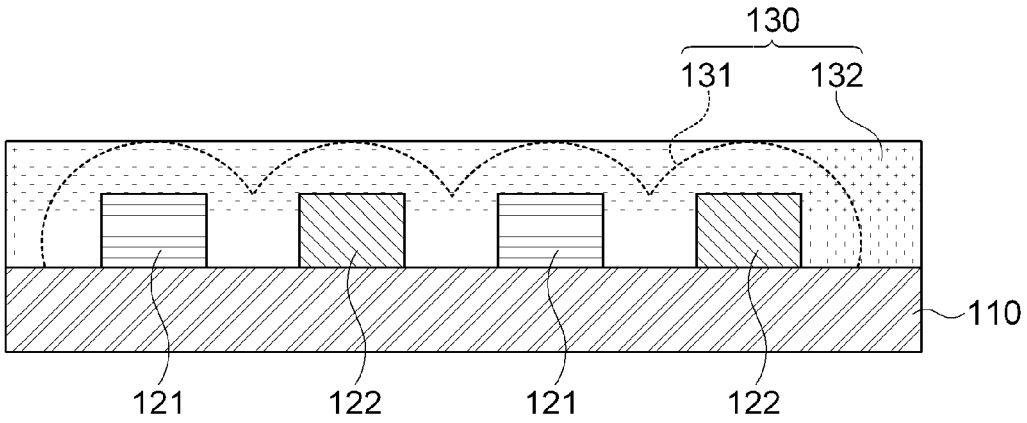

Further, FIGS. 10*a* and 10*b* are process diagrams schematically showing a process of forming an insulating layer on the primary and secondary lower patterns, wherein FIG. 10*a* is a view showing the state in which a primary coating layer is formed on the primary and secondary lower patterns, and FIG. 10*b* is a view showing the state in which a secondary coating layer is formed on the primary coating layer of FIG. 10*a*.

Figure 11:
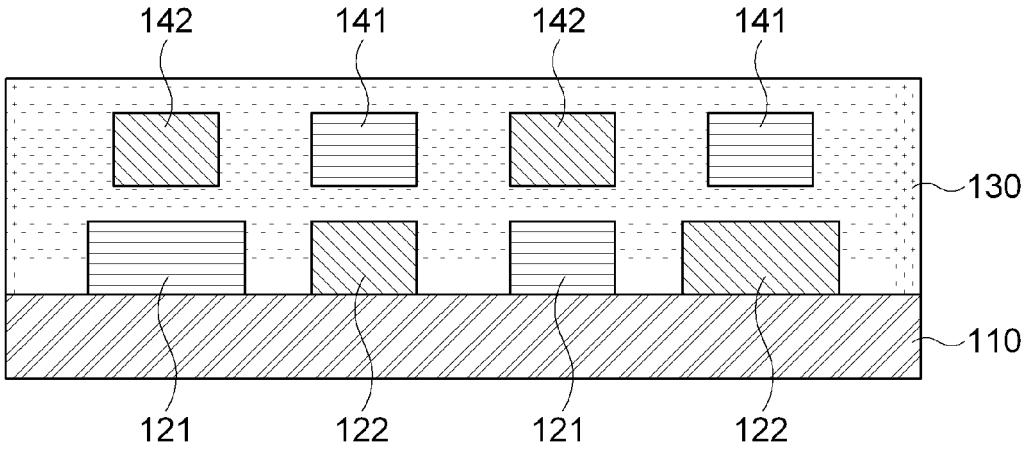
FIG. 11 is a cross-sectional view schematically showing another shape of the primary and secondary lower patterns applied to the filter for removing noise in accordance with the present invention.
Figure 12:
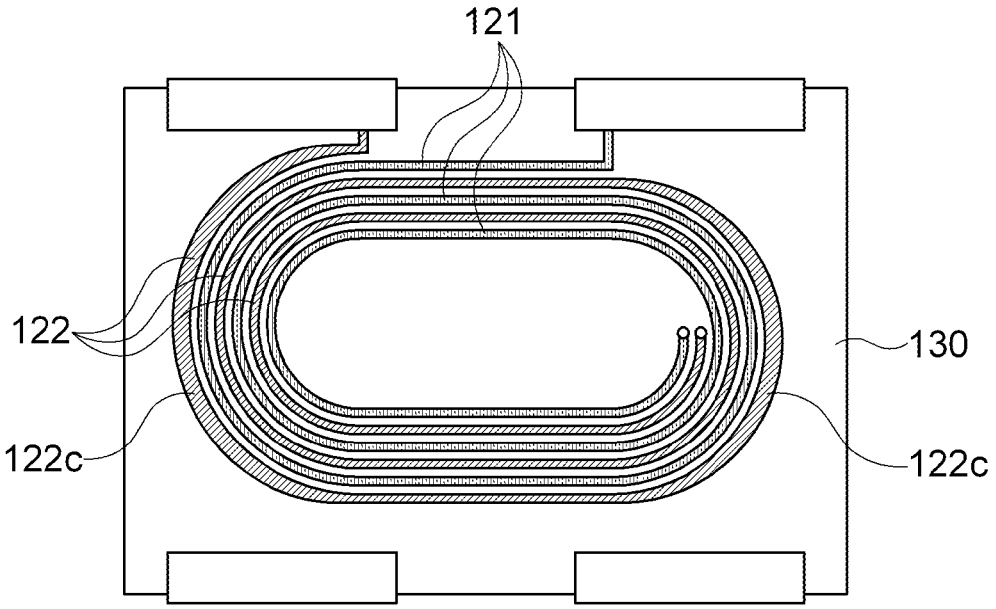
FIG. 12 is a plan view showing the shape of the primary and secondary lower patterns modified to adjust a difference in resistance due to a difference in length between the primary and secondary lower patterns in an embodiment of the filter for removing noise in accordance with the present invention.

Meanwhile, FIG. 11 is a cross-sectional view schematically showing another shape of the primary and secondary lower patterns applied to the filter for removing noise in accordance with the present invention, and FIG. 12 is a plan view showing the shape of the primary and secondary lower patterns modified to adjust a difference in resistance due to a difference in length between the primary and secondary lower patterns in an embodiment of the filter for removing noise in accordance with the present invention.

Referring to FIGS. 3 to 6*b*, an embodiment 100 of a filter for removing noise in accordance with the present invention may include a lower magnetic body 110, primary and secondary lower patterns 121 and 122 provided on the lower magnetic body 110, primary and secondary upper patterns 141 and 142 provided on the primary and secondary lower patterns 121 and 122, an insulating layer 130 for covering the primary and secondary lower patterns 121 and 122 and the primary and secondary upper patterns 141 and 142, and an upper magnetic body 150 provided on the insulating layer 130.

The lower magnetic body 110 may be formed in the shape of a substrate made of a ferrite magnetic material.

The primary and secondary lower patterns 121 and 122 may be spirally provided in parallel to each other while being formed on the lower magnetic body 110 through a thin-film process, and the primary and secondary upper patterns 141 and 142 may be spirally provided on the primary and secondary lower patterns 121 and 122 in parallel to each other to correspond to the primary and secondary lower patterns 121 and 122 while being electrically connected to the primary and secondary lower patterns 121 and 122, respectively.

At this time, the primary lower pattern 121 and the primary upper pattern 141 may be electrically connected through a via to continue each other, and the secondary lower pattern 122 and the secondary upper pattern 142 also may be connected through a via to continue each other.

Accordingly, the filter 100 for removing noise of the present embodiment can improve performance by providing the primary pattern and the secondary pattern, that is, two coil patterns on the same layer.

As an example, it is possible to implement characteristics of the filter for removing noise by using the insulating layer 130 including the primary and secondary lower patterns 121 and 122 or the primary and secondary upper patterns 141 and 142 as a single coil layer, but filter 100 for removing noise in accordance with the present embodiment can have excellent performance and characteristics and further increase capacity by implementing the filter for removing noise by using the vertically multilayered insulating layer 130 in which the primary and secondary lower patterns 121 and 122 and the primary and secondary upper patterns 141 and 142 are provided to vertically correspond to each other as a coil layer to further maximize generation of electromagnetic force of the filter for removing noise.

Here, in the filter 100 for removing noise of the present embodiment, it is preferred that each of the primary and secondary lower patterns 121 and 122 and the primary and secondary upper patterns 141 and 142 is formed to have a ratio of vertical thickness (T) to horizontal width (W) of $0.27 \leq T/W \leq 2.4$.

More specifically, in the filter 100 for removing noise of the present embodiment, the results of checking changes in characteristics, that is, DC resistance (Rdc), common-mode (CM) impedance, and insertion loss according to the ratio of vertical thickness (T) to horizontal width (W) of each of the primary and secondary lower patterns 121 and 122 and the primary and secondary upper patterns 141 and 142 are as described in the following table 1. At this time, a horizontal interval between the primary and secondary lower patterns 121 and 122 and a horizontal interval between the primary and secondary upper patterns 141 and 142 are all 5 μm, and a vertical interval between the lower patterns 121 and 122 and the upper patterns 141 and 142 is 5 μm.

TABLE 1

| Horizontal Width (W)(μm) | Vertical Thickness (T)(μm) | Ratio (T/W) | DC resistance (Rdc Ω) | CM Impedance (Ω) @100 MHz | Insertion Loss (Cutoff Freq.) (GHz) |
|---|---|---|---|---|---|
| 3 | 20 | 6.67 | 6.25 | 70.1 | 2.656 |
| 4 | 15 | 3.75 | 6.17 | 78.4 | 3.512 |
| 5 | 12 | 2.40 | 6.10 | 86.5 | 4.258 |
| 6 | 10 | 1.67 | 6.03 | 90.9 | 4.487 |
| 7.75 | 7.75 | 1.00 | 5.90 | 95.9 | 4.656 |
| 10 | 6 | 0.60 | 5.74 | 98.6 | 4.626 |
| 12 | 5 | 0.42 | 5.60 | 98.6 | 4.508 |
| 15 | 4 | 0.27 | 5.40 | 95.2 | 4.262 |
| 20 | 3 | 0.15 | 5.05 | 79.3 | 3.669 |
| 24 | 2.4 | 0.10 | 4.70 | 59.2 | 2.933 |

As in the table 1, when the ratio (T/W) of vertical thickness (T) to horizontal width (W) of each of the primary and secondary lower patterns 121 and 122 and the primary and secondary upper patterns 141 and 142 is less than 0.27 or exceeds 2.4, the CM impedance is remarkably reduced and the insertion loss (cutoff frequency) is rapidly reduced.

That is, when the ratio (T/W) is less than 0.27, since a cross-section of each of the primary and secondary lower patterns 121 and 122 and the primary and secondary upper patterns 141 and 142 has a horizontally long rectangular shape to elongate a magnetic flux path and reduce an internal area, the CM impedance is reduced, and since a vertically overlapping area of the lower patterns 121 and 122 and the upper patterns 141 and 142 is increased to cause an increase in capacitance between the patterns, the insertion loss is reduced.

Further, when the ratio (T/W) exceeds 2.4, since the cross-section of each of the primary and secondary lower patterns 121 and 122 and the primary and secondary upper patterns 141 and 142 has a vertically long rectangular shape to elongate a magnetic flux path, the CM impedance is reduced by an Ampere's circuital law, and since a horizontally overlapping area of the primary and secondary lower patterns 121 and 122 and a horizontally overlapping area of the primary and secondary upper patterns 141 and 142 are increased to cause the increase in the capacitance between the patterns, the insertion loss is reduced.

And, in the filter 100 for removing noise of the present embodiment, the horizontal interval (S) between the primary and secondary lower patterns 121 and 122 and between the primary and secondary upper patterns 141 and 142 may be in the range of $3.5 \leq S \leq 12.5$. Accordingly, it is possible to improve the characteristics and performance of the filter for removing noise.

More specifically, in the filter 100 for removing noise of the present embodiment, the results of checking changes in the characteristics of the filter for removing noise, that is, DC resistance (Rdc), CM impedance, and insertion loss by changing the horizontal interval (S) between the primary and secondary lower patterns 121 and 122 and the horizontal interval (S) between the primary and secondary upper patterns 141 and 142 according to the predetermined vertical interval (G) between the lower patterns 121 and 122 and the upper patterns 141 and 142 are as described in the following table 2. At this time, the horizontal width of the primary and secondary lower patterns 121 and 122 and the horizontal width of the primary and secondary upper patterns 141 and 142 are all 10 μm, and the vertical width of the primary and secondary lower patterns 121 and 122 and the vertical width of the primary and secondary upper patterns 141 and 142 are all 6 μm.

TABLE 2

| Vertical Interval [G] (μm) | Horizontal Interval [S] (μm) | DC resistance (Rdc Ω) | CM Impedance (Ω) @100 MHz | Insertion Loss (Cutoff Freq.) (GHz) |
|---|---|---|---|---|
| 2.5 | 2.0 | 5.92 | 111.2 | 2.253 |
| | 3.5 | 5.83 | 107.9 | 4.103 |
| | 5.0 | 5.74 | 103.4 | 4.429 |
| | 7.5 | 5.60 | 97.7 | 4.722 |
| | 10.0 | 5.45 | 91.2 | 4.895 |
| | 12.5 | 5.31 | 85.4 | 4.871 |
| | 15 | 5.16 | 73.9 | 4.820 |
| 7.5 | 2.0 | 5.92 | 103.2 | 2.757 |
| | 3.5 | 5.83 | 99.1 | 4.933 |
| | 5.0 | 5.74 | 94.9 | 6.224 |
| | 7.5 | 5.60 | 89.8 | 7.649 |
| | 10.0 | 5.45 | 84.9 | 7.368 |
| | 12.5 | 5.31 | 80.0 | 7.198 |
| | 15.0 | 5.16 | 68.2 | 7.006 |
| 15.0 | 2.0 | 5.92 | 95.2 | 2.831 |
| | 3.5 | 5.84 | 91.4 | 7.082 |
| | 5.0 | 5.75 | 87.6 | 8.780 |
| | 7.5 | 5.60 | 83.0 | 9.198 |
| | 10.0 | 5.45 | 79.8 | 9.099 |
| | 12.5 | 5.31 | 75.2 | 8.848 |
| | 15.0 | 5.16 | 62.9 | 8.702 |

As in the table 2, when the horizontal width (S) between the primary and secondary lower patterns 121 and 122 and between the primary and secondary upper patterns 141 and 142 is less than 3.5 μm, the insertion loss is remarkably reduced, and when the horizontal width (S) exceeds 12.5 μm, the CM impedance is remarkably reduced.

In other words, when the horizontal width (S) between the primary and secondary lower patterns 121 and 122 and between the primary and secondary upper patterns 141 and 142 is less than 3.5 μm, that is, when the horizontal width between the patterns is too small, the insertion loss is increased due to the increase in the capacitance between the patterns, and when the horizontal width (S) between the primary and secondary lower patterns 121 and 122 and between the primary and secondary upper patterns 141 and 142 exceeds 12.5 μm, that is, when the horizontal width between the patterns is too large, the CM impedance is reduced due to a reduction in internal area of each pattern.

Meanwhile, as described above, in the filter 100 for removing noise of the present embodiment, since the primary pattern and the secondary pattern, that is, two coil patterns are provided on the same layer so that input-side lead patterns 121*a* and 122*a* of the primary and secondary lower patterns 121 and 122 can be formed together on the layer on which the primary and secondary lower patterns 121 and 122 are formed and output-side lead patterns 141*b* and 142*b* of the primary and secondary upper patterns 141 and 142 can be formed on the layer on which the primary and secondary upper patterns 141 and 142 are formed, an additional layer for forming an output-side lead pattern is not required compared to the conventional common-mode filter so that it is possible to reduce the thickness of the insulating layer 130 which covers the primary and secondary lower patterns 121 and 122 and the primary and secondary upper patterns 141 and 142, thus implementing miniaturization according to a reduction in vertical height of the filter for removing noise including the insulating layer 130.

And, in the filter 100 for removing noise of the present embodiment, since the primary pattern and the secondary pattern are provided on the same horizontal layer, that is, since the primary lower pattern 121 and the secondary lower pattern 122 are alternately provided on the same horizontal layer and the primary upper pattern 141 and the secondary upper pattern 142 are alternately provided on the same horizontal layer, as shown in FIG. 7, magnetic fluxes flowing between the primary and secondary lower patterns 121 and 122 and the primary and secondary upper patterns 141 and 142 offset each other to reduce differential-mode impedance. Accordingly, it is possible to improve the characteristics of the filter for removing noise by reducing the insertion loss as well.

That is, as shown in FIGS. 8*a* and 8*b*, according to the result of simulation of the characteristics of the conventional common-mode filter and the filter 100 for removing noise of the present embodiment, it is possible to check that the differential-mode impedance is reduced and the insertion loss is improved in the present embodiment compared to the conventional common-mode filter.

Meanwhile, the filter 100 for removing noise of the present embodiment may have portions which cross the primary and secondary lower patterns 121 and 122 on the plane in the curved portions of the primary and secondary upper patterns 141 and 142.

That is, the primary upper pattern 141 may have a portion, which crosses the primary lower pattern on the plane, on the primary lower pattern 121, and the secondary upper pattern 142 may have a portion, which crosses the secondary lower pattern on the plane, on the secondary lower pattern 122.

Accordingly, although not shown in detail, the primary and secondary upper patterns 141 and 142 may be arranged to be positioned in a space between the primary and secondary lower patterns 121 and 122, that is, between the primary lower pattern 121 and the secondary lower pattern 122 in the crossing portions.

And, the primary and secondary upper patterns 141 and 142 may be arranged to be positioned on the primary and secondary lower patterns 121 and 122 in the portions except the crossing portions, that is, in the linear portions.

At this time, the primary and secondary upper patterns 141 and 142 may be arranged to cross the arrangement of the primary and secondary lower patterns 121 and 122.

That is, the secondary upper pattern 142 may be arranged to be positioned on the primary lower pattern 121, and the primary upper pattern 141 may be arranged to be positioned on the secondary lower pattern 122.

And, as shown in FIG. 9*a*, the primary and secondary upper patterns 141 and 142 may be arranged equally to the arrangement of the primary and secondary lower patterns 121 and 122.

That is, the primary upper pattern 141 may be arranged to be positioned on the primary lower pattern 121, and the secondary upper pattern 142 may be arranged to be positioned on the secondary lower pattern 122.

Further, as shown in FIGS. 9*b* and 9*c*, the primary and secondary lower patterns 121 and 122 and the primary and secondary upper patterns 141 and 142 may be alternately arranged in the unit of a plurality of turns.

That is, as in FIG. 9*b*, the primary lower pattern 121 may be continuously arranged in the unit of more than two turns, and the secondary lower pattern 122 may be continuously arranged inside the primary lower pattern 121 in the unit of more than two turns. The secondary upper pattern 142 may be continuously arranged in the unit of more than two turns, and the primary upper pattern 141 may be continuously arranged inside the secondary upper pattern 142 in the unit of more than two turns.

Further, as in FIG. 9*c*, the primary and secondary lower patterns 121 and 122 and the primary and secondary upper patterns 141 and 142 may be arranged in the unit of a plurality of turns, and the vertical arrangement of the primary and secondary lower patterns 121 and 122 and the vertical arrangement of the primary and secondary upper patterns 141 and 142 may be asymmetrical to each other.

Meanwhile, referring to FIGS. 10*a* and 10*b*, in the filter for removing noise of the present embodiment, the insulating layer 130, which covers the primary and secondary lower patterns 121 and 122, may include a primary coating layer 131 and a secondary coating layer 132 for planarizing an upper surface of the primary coating layer 131.

That is, when the insulating layer 130 for covering the primary and secondary lower patterns 121 and 122 is formed by once coating, as in FIG. 10*a*, unevenness may be formed on an upper surface of the insulating layer 130. Accordingly, it is difficult to form the primary and secondary upper patterns on upper surfaces of the primary and secondary lower patterns 121 and 122 in the accurate position and shape.

Therefore, it is possible to planarize the upper surface of the insulating layer 130, which covers the primary and secondary lower patterns 121 and 122, by forming the secondary coating layer 132 on the primary coating layer 131 having the unevenness on the upper surface. Accordingly, it is possible to accurately form the primary and secondary upper patterns on the primary and secondary lower patterns 121 and 122.

Meanwhile, although the insulating layer 130 for covering the primary and secondary lower patterns 121 and 122 is formed by twice coating, a region in which the primary and secondary lower patterns 121 and 122 are not formed, that is, the innermost and outermost upper surfaces of the insulating layer 130 may not be coated. Accordingly, the arrangement of the primary and secondary upper patterns positioned in the uncoated region may be deviated.

Therefore, as shown in FIG. 11, the width of the primary and the secondary patterns 121 and 122 may be larger than the width of the primary and secondary upper patterns 141 and 142.

Particularly, the width of the innermost pattern and the outermost pattern of the primary and secondary lower patterns 121 and 122 may be larger than the width of the pattern positioned between the innermost pattern and the outermost pattern.

Meanwhile, referring to FIG. 12, the filter 100 for removing noise of the present embodiment may further include a resistance tuning portion 122*c* which expands from a portion of the outermost pattern of the longer pattern of the primary and secondary lower patterns 121 and 122.

At this time, in the present embodiment, the longer pattern may be the secondary lower pattern 122. Accordingly, the secondary lower pattern 122 may have the resistance tuning portion 122*c* which expands from a portion of the outermost pattern.

Therefore, the filter 100 for removing noise in accordance with the present embodiment can prevent performance degradation due to a difference in resistance by adjusting the difference in the resistance due to a difference in length between the primary and secondary lower patterns 121 and 122 through the resistance tuning portion 122*c*.

Meanwhile, the upper magnetic body 150 may be formed by filling a ferrite magnetic material on the primary and secondary upper patterns 141 and 142. At this time, although not shown in detail, a center portion of the upper magnetic body 150 may extend to the center of the primary and secondary lower patterns 121 and 122.

Therefore, it is possible to further improve the performance and characteristics of the filter 100 for removing noise of the present embodiment by extending the upper magnetic body 150 to improve a magnetic flux density.

As described above, according to the filter for removing noise in accordance with the present invention, it is possible to improve characteristics and performance of a filter for removing noise by implementing high CM impedance in the same frequency, reducing differential-mode impedance, and improving insertion loss.

And, according to the filter for removing noise in accordance with the present invention, it is possible to improve a capacity of a filter for removing noise.

Further, according to the filter for removing noise in accordance with the present invention, it is possible to reduce manufacturing costs of a filter for removing noise and improve productivity by simplifying structures and processes.

The above-described preferred embodiments of the present invention are disclosed for the purpose of exemplification and it will be appreciated by those skilled in the art that various substitutions, modifications and variations may be made in these embodiments without departing from the technical spirit of the present invention. Such substitutions and modifications are intended to be included in the appended claims.

What is claimed is:

1. A filter for removing noise, comprising:

a lower magnetic body;

primary and secondary patterns spirally provided on the lower magnetic body in parallel to each other, the primary and secondary patterns being coplanar;

an insulating layer to cover the primary and secondary patterns; and an upper magnetic body provided on the insulating layer, wherein the primary and secondary patterns are formed to have a ratio of vertical thickness (T) to horizontal width (W) of $0.27 \leq T/W \leq 2.4$.

2. The filter for removing noise according to claim 1, wherein a horizontal interval (S) between the primary and secondary patterns is in the range of $3.5\ \mu m \leq S \leq 12.5\ \mu m$.

3. The filter for removing noise according to claim 1, further comprising:

a resistance tuning portion which expands from a portion of the outermost pattern of the longer pattern of the primary and secondary patterns.

4. The filter for removing noise according to claim 1, wherein the upper magnetic body extends to the center of the primary and secondary patterns.

5. A filter for removing noise, comprising:

a lower magnetic body;

primary and secondary patterns spirally provided on the lower magnetic body in parallel to each other, the primary and secondary patterns being coplanar;

an insulating layer to cover the primary and secondary patterns; and an upper magnetic body provided on the insulating layer, wherein a horizontal interval (S) between the primary and secondary patterns is in the range of $3.5\ \mu m \leq S \leq 12.5\ \mu m$.

6. A filter for removing noise, comprising:

a lower magnetic body;

primary and secondary lower patterns spirally provided on the lower magnetic body in parallel to each other;

primary and secondary upper patterns spirally provided on the primary and secondary lower patterns in parallel to each other to correspond to the primary and secondary lower patterns while being electrically connected to the primary and secondary lower patterns, respectively;

an insulating layer to cover the primary and secondary lower patterns and the primary and secondary upper patterns; and an upper magnetic body provided on the insulating layer, wherein the primary and secondary lower patterns and the primary and secondary upper patterns are formed to have a ratio of vertical thickness (T) to horizontal width (W) of $0.27 \leq T/W \leq 2.4$.

7. The filter for removing noise according to claim 6, wherein a horizontal interval (S) between the primary and secondary lower patterns and a horizontal interval (S) between the primary and secondary upper patterns are in the range of $3.5\ \mu m \leq S \leq 12.5\ \mu m$.

8. The filter for removing noise according to claim 6, wherein the primary and secondary upper patterns are arranged to cross the primary and secondary lower patterns.

9. The filter for removing noise according to claim 6, wherein the insulating layer comprises a primary coating layer to cover the primary and secondary lower patterns and a secondary coating layer for planarizing an upper surface of the primary coating layer.

10. The filter for removing noise according to claim 6, wherein the width of the primary and secondary lower patterns is larger than the width of the primary and the secondary upper patterns.

11. The filter for removing noise according to claim 10, wherein the width of the innermost pattern and the outermost pattern of the primary and secondary lower patterns is larger than the width of the pattern positioned between the innermost pattern and the outermost pattern.

12. The filter for removing noise according to claim 6, wherein the primary and secondary upper patterns are formed in a spiral shape continuing from the primary and secondary lower patterns and having the same number of turns.

13. The filter for removing noise according to claim 6, further comprising:

a resistance tuning portion which expands from a portion of the outermost pattern of the longer pattern of the primary and secondary lower patterns.

14. The filter for removing noise according to claim 6, wherein the primary and secondary upper patterns and the primary and secondary lower patterns are electrically connected through vias.

15. The filter for removing noise according to claim 6, wherein the upper magnetic body extends to the center of the primary and secondary upper patterns and the primary and secondary lower patterns.

16. A filter for removing noise, comprising:

a lower magnetic body;

primary and secondary lower patterns spirally provided on the lower magnetic body in parallel to each other;

primary and secondary upper patterns spirally provided on the primary and secondary lower patterns in parallel to each other to correspond to the primary and secondary lower patterns while being electrically connected to the primary and secondary lower patterns, respectively;

an insulating layer to cover the primary and secondary lower patterns and the primary and secondary upper patterns; and an upper magnetic body provided on the insulating layer, wherein a horizontal interval (S) between the primary and secondary lower patterns and a horizontal interval (S) between the primary and secondary upper patterns are in the range of $3.5\ \mu m \leq S \leq 12.5\ \mu m$.

* * * * *